US006729523B1

(12) United States Patent
Wang et al.

(10) Patent No.: US 6,729,523 B1
(45) Date of Patent: May 4, 2004

(54) NAIL CARTRIDGE STRUCTURE FOR NAIL GUN

(75) Inventors: Jack Wang, Taoyuan (TW); Wen Tai Chou, Taoyuan (TW); Liang Ming Lin, Taoyuan (TW)

(73) Assignee: Waffer Technology Corp., Tao Yuan (TW)

( * ) Notice: Subject to any disclaimer, the term of this patent is extended or adjusted under 35 U.S.C. 154(b) by 0 days.

(21) Appl. No.: 10/300,764

(22) Filed: Nov. 21, 2002

(51) Int. Cl.[7] ..... B27F 7/00
(52) U.S. Cl. ..... 227/120; 227/109
(58) Field of Search ..... 227/109, 120, 227/136, 135, 132, 134, 107

(56) References Cited

U.S. PATENT DOCUMENTS 3,633,811 A * 1/1972 Ploen ..... 227/109
5,615,819 A * 4/1997 Hou et al. ..... 227/109
6,502,737 B2 * 1/2003 Akiba ..... 227/109

* cited by examiner

*Primary Examiner*—Stephen F. Gerrity
*Assistant Examiner*—Thanh Truong
(74) *Attorney, Agent, or Firm*—Browdy and Neimark, P.L.L.C.

(57) ABSTRACT

A nail cartridge structure for a nail gun has at least two nail cartridges and a nail cartridge switching unit that is connected to a front end of the gun body. The nail cartridges are used to hold either one size of nails or different sizes of nails, respectively. The nail cartridge switching unit is connected to the nail cartridges and is operated by the user to selectively switch the nail feed to the desired nail cartridge.

7 Claims, 6 Drawing Sheets

NAIL CARTRIDGE STRUCTURE FOR NAIL GUN

BACKGROUND OF THE INVENTION

1. Field of the Invention

The invention relates to a nail cartridge structure for a nail gun and, more particularly, to a nail cartridge structure that can accommodate nail cartridges containing different sizes of nails and selectively switch to one desired nail cartridge.

2. Description of the Related Art

The use of a nail gun is known in the art to shoot conveniently nails into an object. The nail gun conventionally comprises a gun body that is connected to a nail cartridge. The nail cartridge contains nails that are continuously fed to the front end of the gun body to be shot in.

Unfortunately, the conventional nail gun can only accommodate one nail cartridge. Therefore, only one size of nail is provided during each use. If the user wishes to use another size of nails, either another nail cartridge containing the desired size of nails has to be mounted, or nails of the different size have to be inserted in the already-mounted nail cartridge. These processes are cumbersome and time-consuming. Furthermore, in order to allow a larger amount of nails in each recharge, the nail cartridge usually is dimensionally long since only one placement space is provided for one nail cartridge. This results in a cumbersome handling of the nail gun.

SUMMARY OF THE INVENTION

It is therefore a principal object of the invention to provide a nail cartridge structure for a nail gun that can juxtapose a plurality of nail cartridges respectively containing the same or different sizes of nails. Via a simple operation, the user can selectively switch to the desired nail cartridge without the need to mount additional nail cartridges or recharge with nails of other sizes. Thereby, the use of the nail gun is more convenient and more efficient.

It is another object of the invention to provide a nail cartridge structure for a nail gun that accommodate a plurality of nail cartridges that is either longitudinally reduced to render the handling of the nail gun more convenient while allowing the charging of a same amount of nails, or have the conventional long length to increase the number of nails in a recharge.

To accomplish the above and other objectives, a nail cartridge structure for a nail gun comprises a gun body to a front end of which is mounted a nail cartridge switching unit. The nail cartridge switching unit includes a nail slot movable base driven in a sliding motion between a left and right side to perform a switching action between nail cartridges. At least two nail cartridges are further juxtaposed to each other and respectively connected to a bottom of the nail slot movable base.

To provide a further understanding of the invention, the following detailed description illustrates embodiments and examples of the invention that are provided for explaining the invention and should not be construed to limit the scope of the invention.

BRIEF DESCRIPTION OF THE DRAWINGS

The drawings included herein provide a further understanding of the invention. A brief introduction of the drawings is as follows:

FIG. 3 through FIG. 6 are various views illustrating the nail cartridge stem turned downward according to an embodiment of the invention, wherein FIG. 3 and FIG. 4 are perspective views and FIG. 5 and FIG. 6 are planar views; and FIG. 7 through FIG. 10 are various views illustrating the nail cartridge stem turned upward according to an embodiment of the invention, wherein FIG. 7 and FIG. 8 are perspective views and FIG. 9 and FIG. 10 are planar views.

DETAILED DESCRIPTION OF THE EMBODIMENTS

Figure 1:
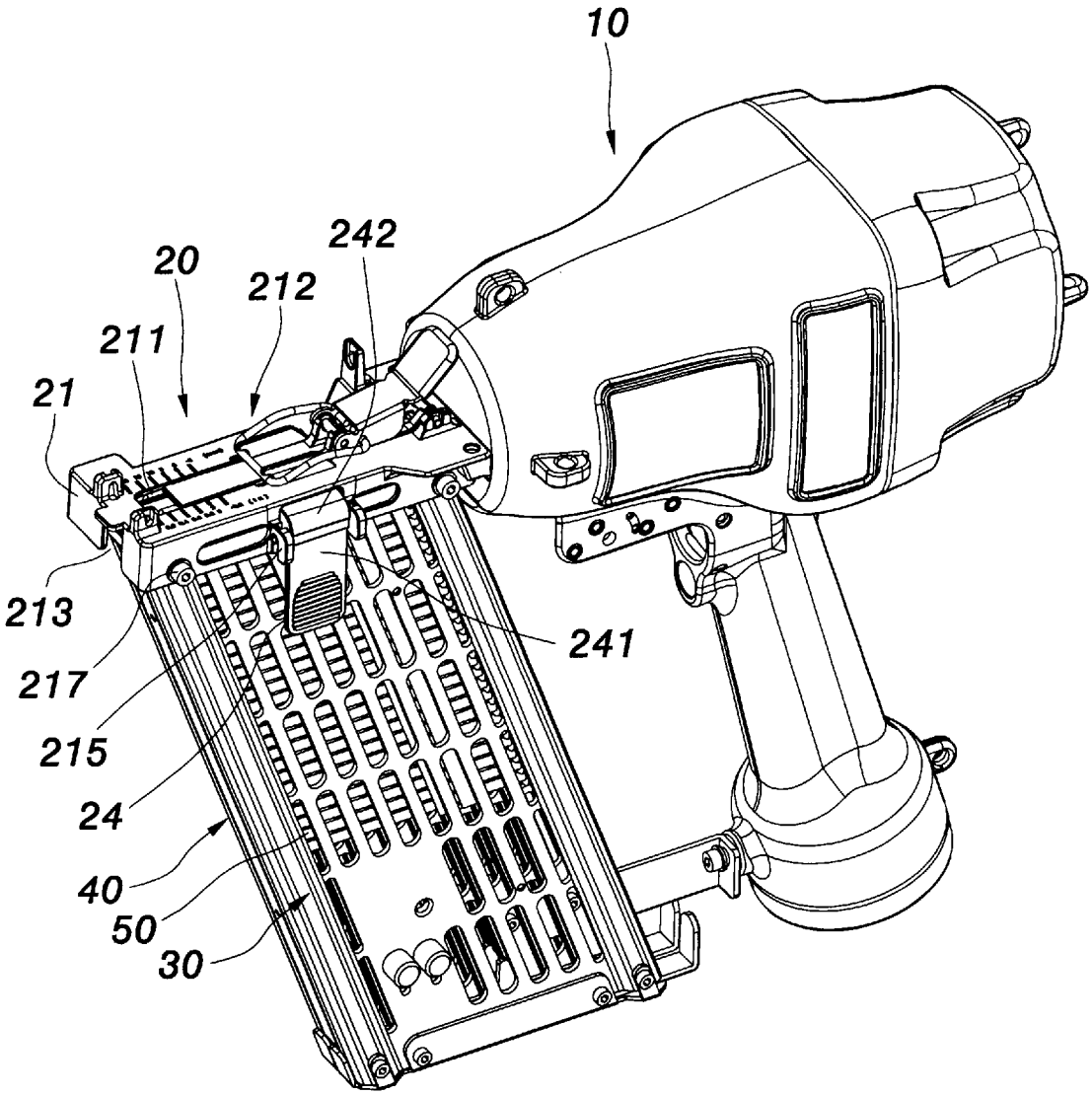
FIG. 1 is an exploded view of a nail cartridge for a nail gun according to an embodiment of the invention.

Wherever possible in the following description, like reference numerals will refer to like elements and parts unless otherwise illustrated.

Figure 2:
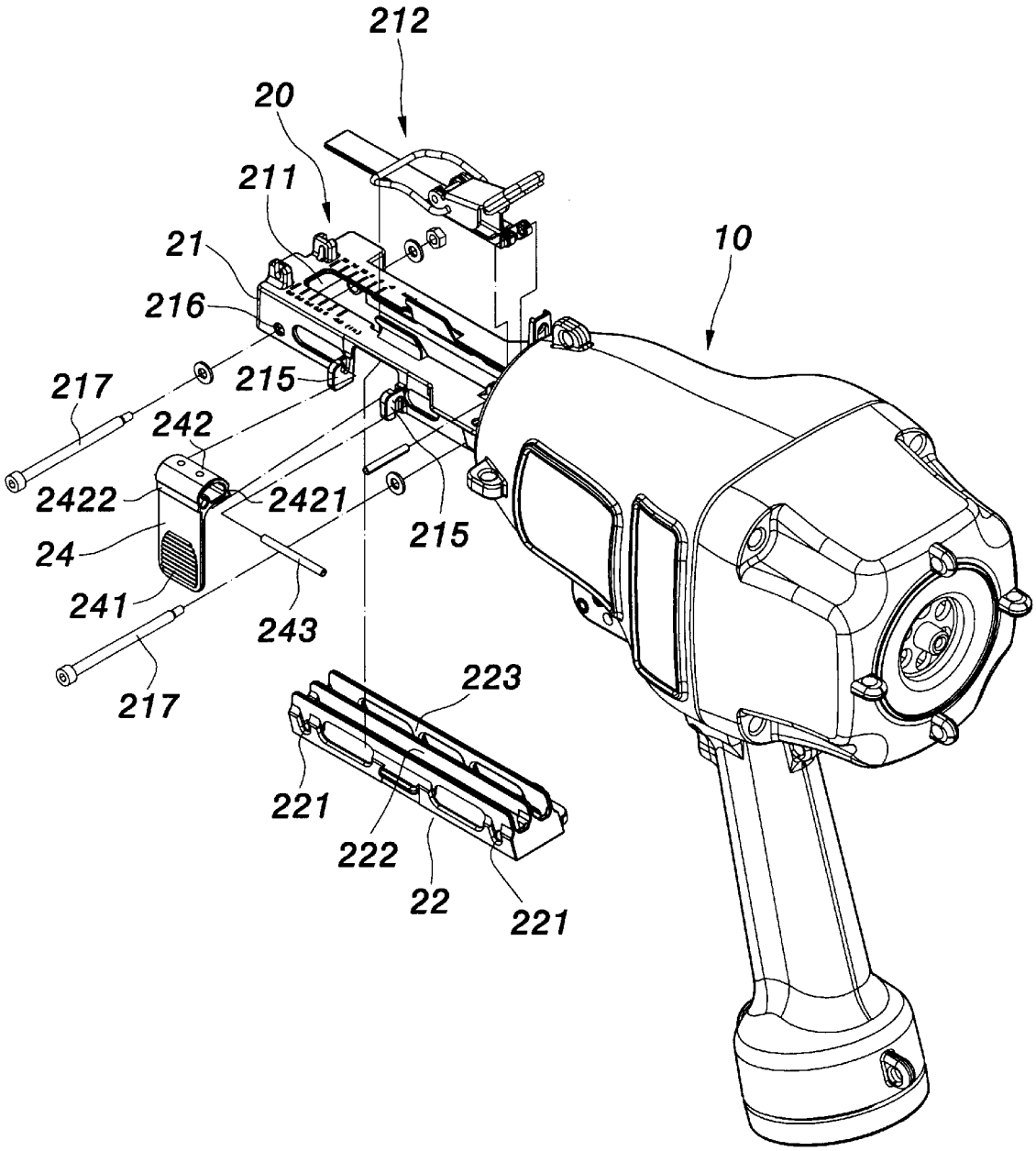
FIG. 2 is an exploded view of a nail gun suitable to the invention (without the nail cartridges mounted)

Referring to FIG. 1 and FIG. 2, the invention provides a nail cartridge structure for a nail gun. A nail gun suitable to the invention comprises, for example, a gun body 10 and a nail cartridge switching unit 20, mounted at a front end of the gun body 10 and connecting to first and second nail cartridges 30, 40 juxtaposed to each other. The nail cartridge switching unit 20 switches the nail feed from either the first or second nail cartridge 30, 40 to the front end of the gun body 10, where compressed gas is used to shoot the nails. A shooting mechanism of the above nail gun is known in the art and is not further mentioned herein.

Figure 3:
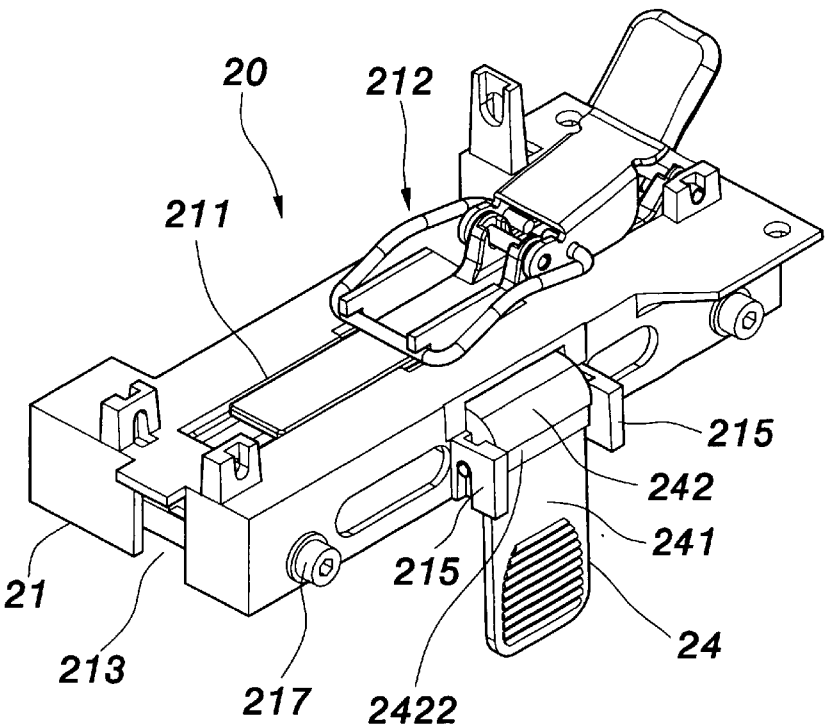
Figure 4:
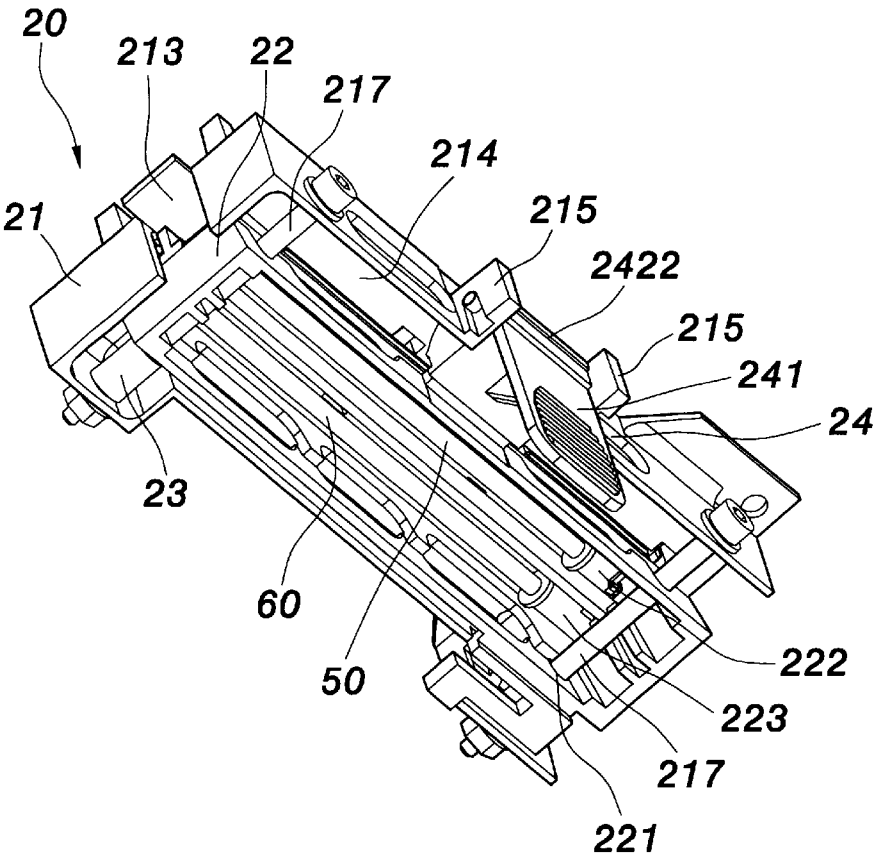

Referring to FIG. 3 and FIG. 4, the nail cartridge switching unit 20 comprises an attachment base 21, a nail slot movable base 22 (also called "movable base" hereafter), two resilient elements 23, and a nail cartridge stem 24. A rear end of the attachment base 21 is fastened to the front end of the gun body 10, which connects the nail cartridge switching unit 20 to the gun body 10. An approximately rectangular groove 211 is formed on the attachment base 21. A panel assembly 212 closes or opens the groove 211. The front end of the attachment base 21 includes a nail output opening 213, and the attachment base 21 further internally defines a placement space 214 in which is received the movable base 22, the placement space 214 communicating with the groove 211. A left side of the attachment base 21 is provided with corresponding hinges 215 that pivotally mount the nail cartridge stem 24. Proximate to the front and rear ends, the left and right sides of the attachment base 21 respectively include fastening holes 216. Guide rods 217 are respectively mounted in the respective fastening holes 216 on the left and right side of the attachment base 21, which slidably mount the movable base 22 thereon.

The nail slot movable base 22 is received in the placement space 214 of the attachment base 21. The nail cartridges 30, 40 are connected to a lower side of the movable base 22. Sliding holes 221 are respectively formed on the movable base 22, respectively proximate to its front and rear end. The guide rods 217 slidably pass through the sliding holes 221, which slidably mounts the movable base 22 on the two guide rods 217. The sliding move of the movable base 22 is thereby guided inside the placement space 214 of the attachment base 21. The movable base 22 is provided with first and second nail slots 222, 223. The nail slots 222, 223 are open at their bottom and front and rear ends, by means of which the nail slots 222, 223 respectively communicate with the interior of the first and second nail cartridges 30, 40. Thereby, nails 50, 60 respectively inside the first and second nail cartridges 30, 40 are respectively delivered through the first and second nail slots 222, 223.

The resilient elements 23 may be, for example, springs, flexible rubber or other adequate mechanically resilient components known in the art. The two resilient elements 23 respectively engage around the two guide rods 217, and are placed between an outer wall of a right side of the movable base 22 and an inner wall of the right side of the attachment base 21. Via the above mount, the resilient elements 23 push the movable base 22 to the left side to recover its initial position. Through either the left or right slide of the movable base 22, either the first or second nail slot 222, 223 is selectively aligned with the nail output opening 213 of the front end of the attachment base 21.

The nail cartridge stem 24 drives and controls the left/right slide of the movable base 22, and comprises a turning portion 241 and a cam portion 242. An end of the nail cartridge stem 24 is pivotally mounted between the two hinges 215 at the left side of the attachment base 21 by means of a pin 243 passing through the stem 24 and hinges 215. Thereby, the turning portion 241 turns the nail cartridge stem 24 either downward (as illustrated in FIG. 3 through FIG. 6) or upward (as illustrated in FIG. 7 through FIG. 10). The cam portion 242 abuts against the outer wall of the movable base 22, and peripherally comprises first and second abutting zones 2421, 2422. The spacing distance between the first abutting zone 2421 and the pin 243 is greater than that between the second abutting zone 2422 and the pin 243. When the nail cartridge stem 24 is turned downward, the first abutting zone 2421 of the cam portion 242 contacts with the movable base 22 that thereby is pushed to the right side (as illustrated in FIG. 3 through FIG. 6). When the nail cartridge stem 24 is turned upward, the second abutting zone 2422 contacts with the movable base 22. The resilient elements 23 consequently push the movable base 22 to the left side (as illustrated in FIG. 7 through FIG. 10).

Figure 5:
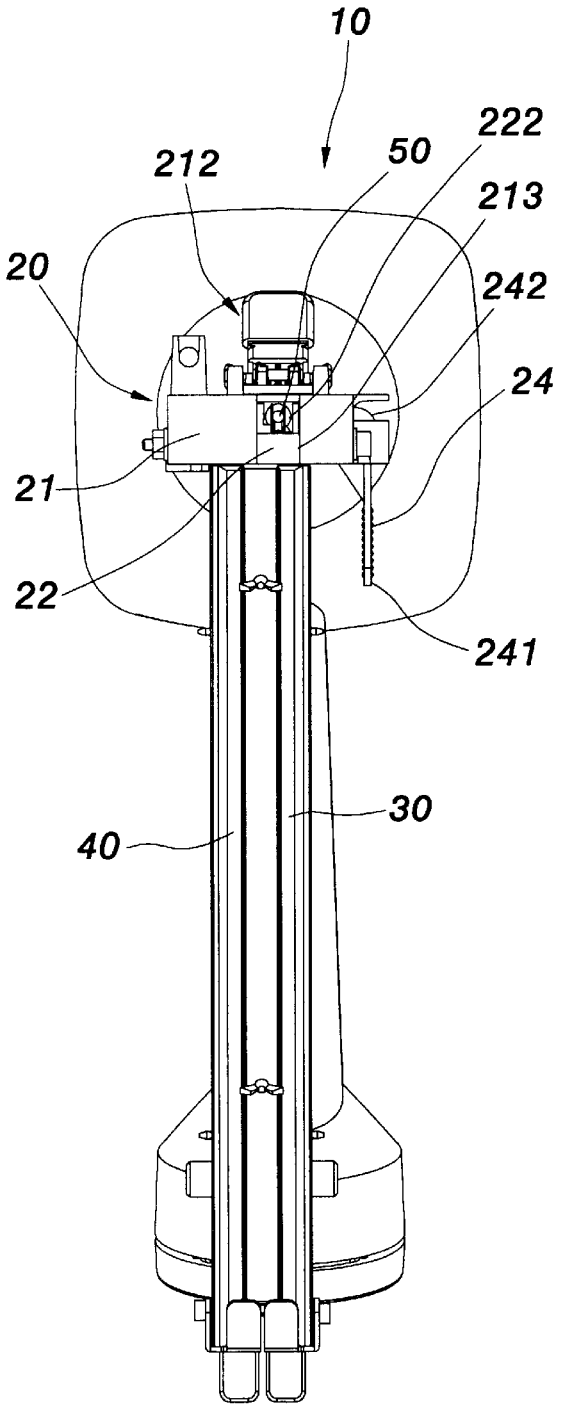
Figure 6:
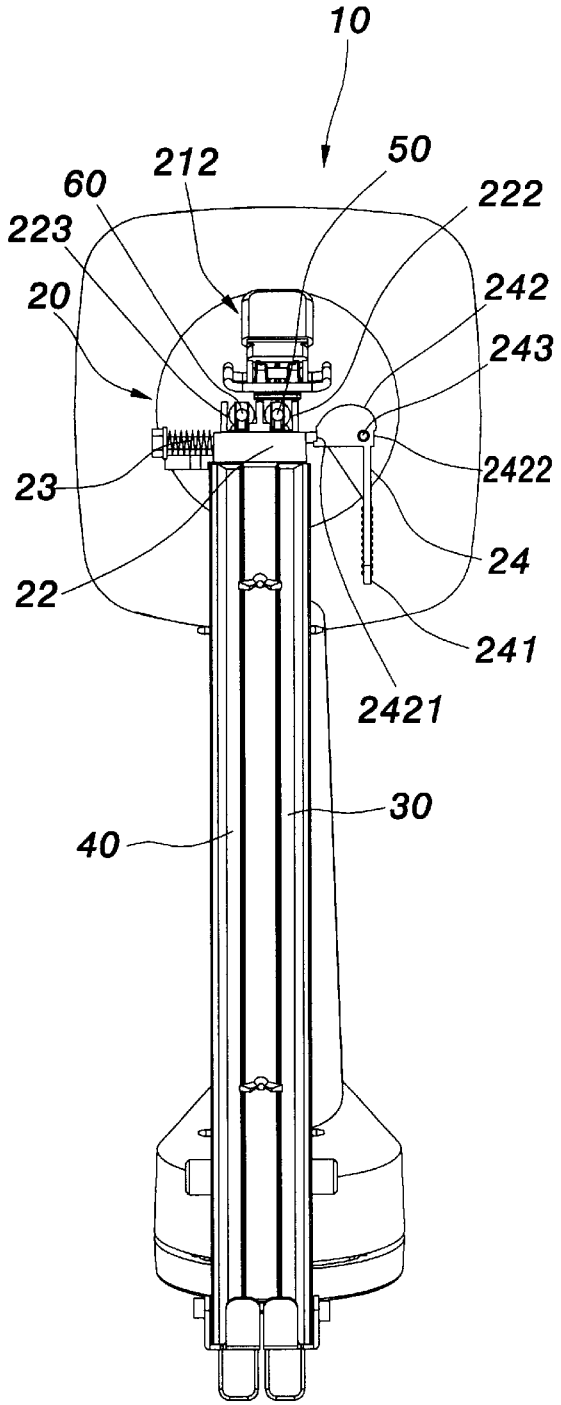
Figure 7:
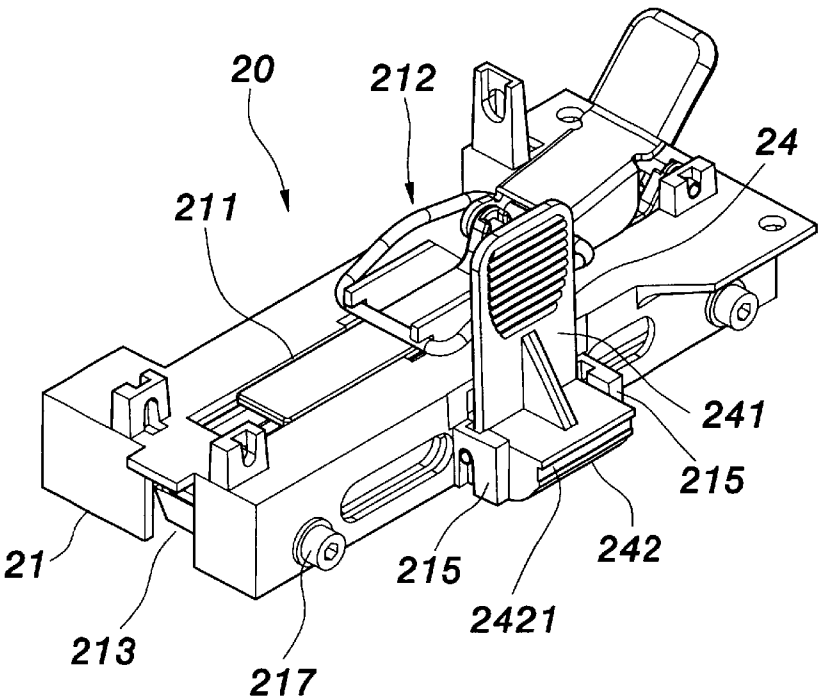
Figure 8:
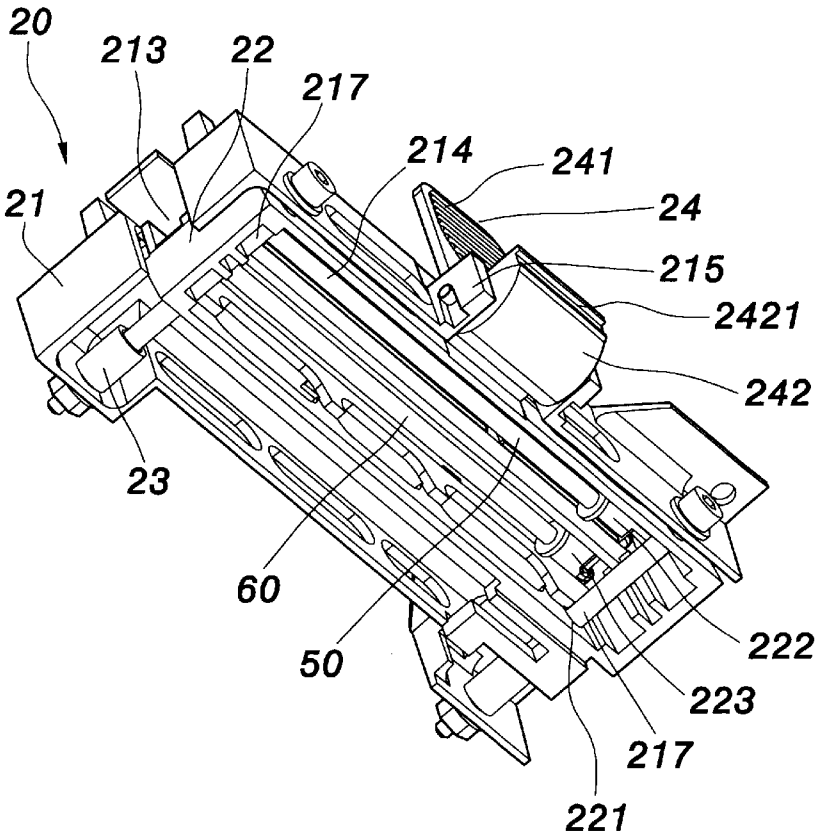

The nail cartridge switching unit 20 is therefore used to selectively switch to the desired nail cartridge 30 or 40. As illustrated in FIG. 3 through FIG. 6, turning downward the nail cartridge stem 24 has the first abutting zone 2421 of the cam portion 242 abut and push the movable base 22 to the left side. This positioning of the movable base 22 on the left side aligns the first nail slot 222 with the nail output opening 213 at the front end of the attachment base 21 (as illustrated in FIG. 5). The nails 50 inside the first nail cartridge 30 are thereby supplied to the first nail slot 222 at the front end of the gun body 10 to be shot via compressed air.

Figure 9:
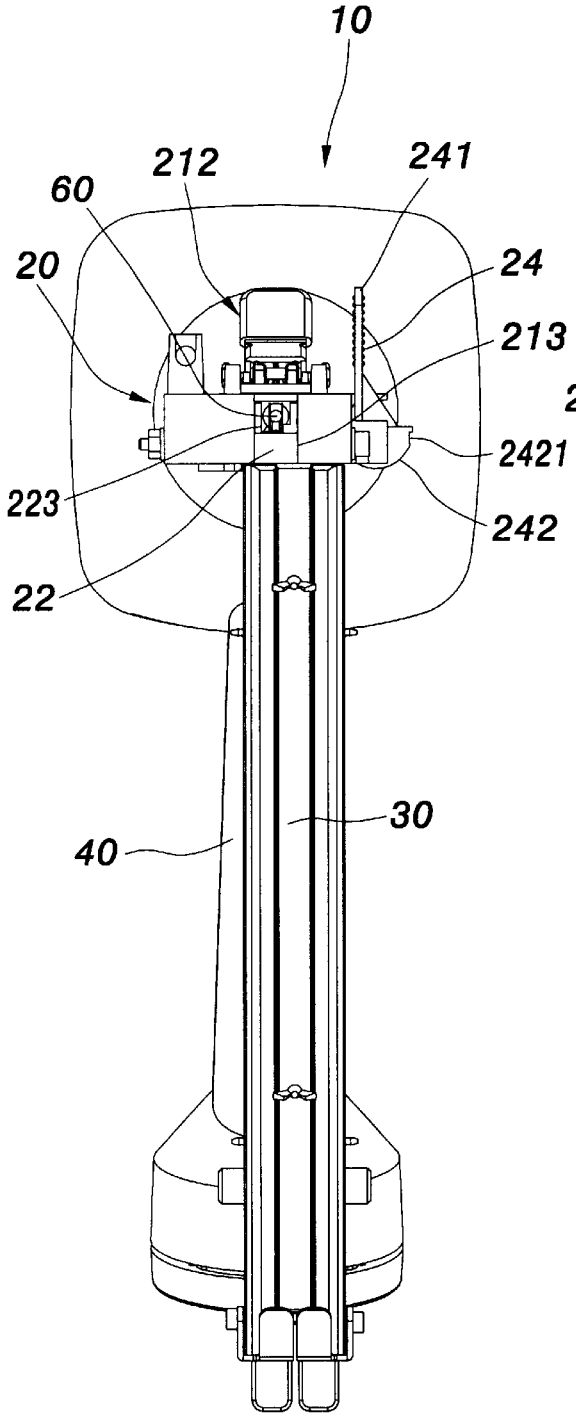
Figure 10:
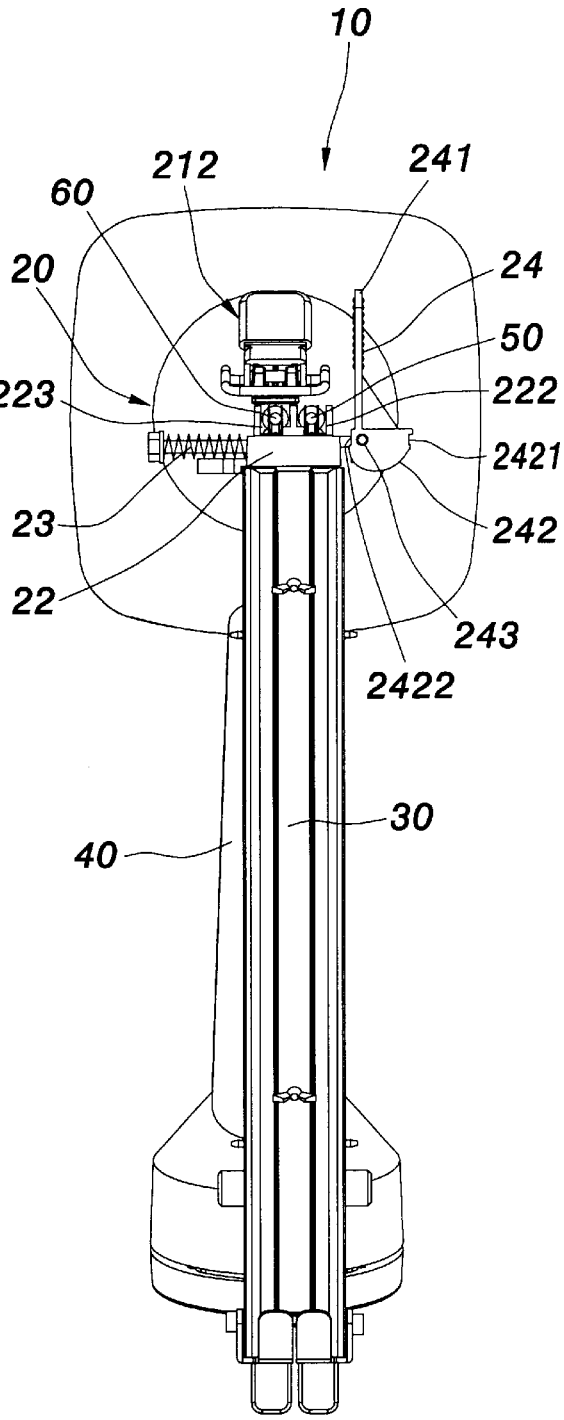

As illustrated in FIG. 7 through FIG. 10, turning upward the nail cartridge stem 24 has the second abutting zone 2422 of the cam portion 242 abut against the movable base 22. As a result, the resilient elements 23 push the movable base 22 to the right side to recover its initial position, which aligns the second nail slot 223 with the nail output opening 213 (as illustrated in FIG. 9). The nails 60 inside the second nail cartridge 40, for example, different in size from the nails 50 inside the first nail cartridge, are thereby supplied to the second nail slot 223 at the front end of the gun body 10 to be shot via compressed air.

As described above, the invention therefore allows the juxtaposed mount of two nail cartridges 30, 40 that can respectively receive nails 50, 60 of different sizes. By operating the nail cartridge switching unit 20, the user can selectively switch to the desired nail cartridge 30 or 40 to work with the adequate size of nails 50 or 60. Thereby, the invention allows a convenient and efficient use of the nail gun, accommodating different sizes of nails.

Although the above description of an embodiment of the invention particularly refers to two nail cartridges 30, 40, the person skilled in the art will readily understand the above structure of the invention may also be implemented to accommodate more than two (for example three or four) nail cartridges. This may be accomplished via simply providing more nail slots on the movable base 22 (not shown) corresponding to the number of provided nail cartridges. More diverse nail sizes may be thereby conveniently accommodated with the invention.

Those skilled in the art will readily appreciate that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A nail cartridge structure for a nail gun, comprising:

a gun body;

a nail cartridge switching unit, mounted on a front end of the gun body, the nail cartridge switching unit including a nail slot movable base driven by a sliding motion between a left and right side to perform a switching action between nail cartridges; and at least two nail cartridges, juxtaposed to each other and respectively connected to a bottom of the nail slot movable base.

2. The structure of claim 1, wherein the nail cartridge switching unit further comprises an attachment base, resilient elements, and a nail cartridge stem, the attachment base being attached to the front end of the gun body, a front end of the attachment base including a nail output opening, the attachment base internally defining a placement space wherein is received the nail slot movable base, the resilient elements being placed between the attachment base and the nail slot movable base, and the nail cartridge stem being pivotally connected to the attachment base and abutting against the nail slot movable base.

3. The structure of claim 2, wherein two hinges are provided at a side of the attachment base to pivotally mount the nail cartridge stem.

4. The structure of claim 2, wherein the attachment base comprises a plurality of fastening holes assembling guide rods slidably engaging through sliding holes of the nail slot movable base, the nail slot movable base thereby sliding along the guide rods.

5. The structure of claim 2, wherein the attachment base further includes a groove, the groove being closed and opened via a panel assembly.

6. The structure of claim 2, wherein the at least two nail slots are formed on the nail slot movable base, the nail slots respectively communicating with the nail cartridges and having bottom, front and rear ends opened, the nail output opening selectively aligning with one of the two nail slots.

7. The structure of claim 2, wherein the nail cartridge stem comprises a turning portion and a cam portion abutting against an outer wall of the nail slot movable base, the cam portion peripherally including at least two different abutting zones.

* * * * *